US005515694A

United States Patent [19]

Meloling et al.

[11] Patent Number: 5,515,694

[45] Date of Patent: May 14, 1996

[54] SUBCOOLER LEVEL CONTROL FOR A TURBINE EXPANSION REFRIGERATION CYCLE

[75] Inventors: Steven E. Meloling; Vishnu M. Sishtla, both of Cicero, N.Y.

[73] Assignee: Carrier Corporation, Syracuse, N.Y.

[21] Appl. No.: 380,116

[22] Filed: Jan. 30, 1995

[51] Int. Cl.[6] ..... F25B 41/00; F25B 1/00

[52] U.S. Cl. ..... 62/197; 62/116; 62/218

[58] Field of Search ..... 62/116, 197, 218

[56] References Cited

U.S. PATENT DOCUMENTS 2,494,120 1/1950 Ferro, Jr. ..... 62/116 X 3,277,658 10/1966 Leonard, Jr. ..... 62/116 X 5,285,653 2/1994 Meloling et al. ..... 62/218

*Primary Examiner*—William E. Wayner

[57] ABSTRACT

A single-fluid two-phase turbine expander is employed in a compression-expansion refrigeration system. The turbine has nozzles of fixed, predetermined orifice and is designed for optimal operation in steady-state normal conditions. A main float valve governs the refrigerant flow to the turbine expander. In order to accommodate off-design conditions, a bypass conduit carries liquid refrigerant around the turbine expander directly to the evaporator. In this case a bypass float valve opens the bypass conduit when the liquid level in the condenser sump reaches a predetermined high level. Alternatively, a float switch and a bypass solenoid can be employed.

6 Claims, 4 Drawing Sheets

SUBCOOLER LEVEL CONTROL FOR A TURBINE EXPANSION REFRIGERATION CYCLE

BACKGROUND OF THE INVENTION

This invention relates to compression/expansion refrigeration, and is particularly concerned with turbine-expansion cycle chiller, air conditioning, heat pump, or refrigeration systems in which a turbo-expander is employed to expand the condensed refrigerant to a reduced pressure and to permit recovery of a portion of the energy of the compressed fluid.

Single-fluid two-phase flow systems typically incorporate an expansion valve, float valve, or other mechanical pressure regulator between the condenser heat exchanger and the evaporator heat exchanger to expand the fluid, i.e., to throttle the flow of refrigerant fluid from a high pressure to a low pressure.

The use of a turbine or turbo-expander in a refrigeration cycle has been previously proposed with the aim of improving the refrigeration efficiency. Some type of bi-phase flow turbine is required to replace the isenthalpic expansion process of a throttling expansion valve with an isentropic expansion process. This is, the turbine absorbs some of the energy of the expanding refrigerant and converts it to rotational energy. At the same time, the liquid fraction of the refrigerant that enters the evaporator is increased. Ideally, the energy of the expanding refrigerant can be recovered and can be used to reduce the amount of motor energy needed to drive the system compressor.

U.S. Pat. No. 4,336,693 describes a refrigeration system that employs a reaction turbine as an expander stage. In this approach, a centrifugal reaction turbine preforms the expansion function, and operates to separate vapor from the liquid before extracting power. This produces increased efficiency over a conventional turbo-expander. In this prior patent, the energy produced by the turbine can be used to drive a load, such as a generator.

However, turbines placed in this role have not been particularly efficient for a number of reasons. In most refrigeration processes, where refrigerant is brought from a saturated liquid phase to a low-quality two-phase liquid/vapor state, the expansion process produces a relatively small amount of work, compared to the work input required for the compressor. Moreover, turbines that have been conventionally employed are not only smaller in capacity than the compressor, but also operate under conditions of low efficiency due to the two-phase flow and speed of the expanding fluid. For optimal efficiency, the two-phase flow turbines also require a completely different speed from the compressor. Consequently, the conventional engineering practice is not to employ a turbine expander because the small amount of savings in energy recovery and efficiency gains are far outweighed by the reduced initial and maintenance costs of a throttling valve.

A single fluid, two-phase-flow turbine expander can be made practical and efficient only if critical relationships of the turbine to the rest of the refrigeration system are observed. Direct coupling of the turbine rotor shaft to the drive of the compressor is possible if the turbine rotor has a design speed that permits it to serve as a high-efficiency expander, the turbine matches the properties of the refrigerant, such as vapor density and two-phase flow acoustic velocity, and the capacity of the refrigeration system (i.e., refrigerator, chiller or air conditioner) satisfies optimal mass flow conditions of the turbine expander. However, no previous system has observed these criteria, and so the desired efficiency increases have not been achieved.

For medium- to high-pressure refrigerants such as R134A and R22, two-phase flow turbo-expanders can be employed, of the type described e.g., in Ritzi et at., U.S. Pat No. 4,298,311, Hays et at. U.S. Pat. No. 4,336,693 and Hays et at. U.S. Pat. No. 4,438,638. These patents relate to turbines driven by a two-phase working fluid where most of the fluid mass (e.g., 90%) is liquid, and one or more nozzles directs the condensed refrigerant at a rotor so that the vapor and liquid mixture impacts the rotor. These turbines are designed as reaction turbines, so that kinetic energy of the expanding vapor is transformed into kinetic shaft output energy rather than into heat. This, in theory, maximizes the liquid fraction of the total mass of the working fluid after expansion.

However, in any given application, the size of the turbine that provides optimal expansion will not provide suitable output shaft power. The turbine's expansion capacity for a given mass flow should be matched with the required shaft speed to permit direct coupling to the compressor drive.

Turbine-expansion cycle refrigeration systems assume a normal, steady-state flow rate and pressure head condition. Under normal conditions, the condenser drain mass flow passes through the two-phase flow turbine expander, and expansion energy is transferred to the compressor drive train. This produces a reduction in the shaft horsepower requirement for the compressor.

Where the turbo-expander is designed as a fixed-geometry device, the turbo expander can operate efficiently over a given range of mass flow and pressure head conditions. These turbo expanders are designed to operate with liquid flow at a given rate and pressure reaching the nozzles. Problems may occur if the refrigeration system is operated at off-design conditions.

At off-design conditions, the pressure head may be too small or the flow rate may be too large to pass the condensed refrigerant efficiently through the turbine nozzles, thus starving the cooler or evaporator stage. If the system head drops, but mass flow is at the design flow rate or higher, the pressure for that volume of flow may be too low to pass the required liquid flow through the turbine nozzles. Liquid refrigerant then stacks up in the sump region of the condenser, starving the evaporator. This condition can force the system to shut down due to low cooler or evaporator pressure.

Accordingly, it is necessary to incorporate some additional means to permit a stable level of refrigerant to be maintained, even when operating outside the design pressure and mass flow conditions, but without interfering with the operation of the turbo-expander.

OBJECTS AND SUMMARY OF THE INVENTION

It is an object of this invention to provide a refrigeration system with a two-phase flow turbine expander, which incorporates bypass means to permit operation outside the design range of the system, and which avoids the drawbacks of the prior art.

It is another object of this invention to provide a bypass conduit which operates when refrigerant liquid begins to back up in the sump of the condenser, but which will not interfere with the efficient operation of the turbo-expander under design operating conditions.

According to an aspect of this invention, a single-fluid two-phase-flow turbine expander with a slightly sub-cooled inlet condition is directly i.e., mechanically coupled to the drive train of the associated refrigeration compressor both to expand the condensed refrigerant isentropieally and also to recover a significant amount of the compression energy of the refrigerant and apply that energy to rotating the compressor.

For a refrigeration system of a capacity of 100 to 1000 tons, employing a high-pressure refrigerant such as R22 or R134A, and a centrifugal or screw compressor driven by a two-pole induction motor (3000 to 3600 rpm), the turbine efficiency is estimated at about 60%. Depending on operating conditions, the turbine reduces the motor load by 6–15% compared to the system with a throttling expansion valve. A similar system employing a low-pressure refrigerant, such as R123 or R245ca, would permit a much smaller recovery due to the need for an increased turbine rotor diameter and lower rotor shaft speed. Ideally, a recovery of about 2–6% is possible.

Efficient energy recovery can also be achieved if the turbine expander is employed in a refrigeration system below 100 ton capacity having a screw compressor or other type of rotary compressor as long as the critical relationship between speed and capacity can be observed. For example, in systems using high pressure refrigerants, the turbine expander can be coupled directly to the high-speed shaft of a 40-ton geared screw compressor, running at 12,000 rpm or an inverter-driven 5-ton scroll compressor running at 40,000 rpm.

In addition to these two examples, many other combinations of compressors and turbines can be used. Each combination is predicated on a particular steady-state refrigerant mass flow rate and pressure level within the condenser stage and evaporator stage. The turbine is preferably of a straightforward simple design, having a rotor disc with peripheral vanes, and a nozzle block that houses the disc and contains a group of fixed nozzles that are directed at the vanes. The mass flow of refrigerant through the nozzles is sufficient to satisfy the evaporator as long as the system is operating under design operating condition. However, if the pressure head drops or if the mass flow rate becomes high, and the system operates under off-design conditions, the refrigerant mass flow allowed through the turbine nozzles can be too small to satisfy the evaporator. This can lead to shutdown of the system from low evaporator pressure.

In several preferred embodiments of this invention, a bypass conduit couples the condenser sump with the evaporator to satisfy the evaporator during certain off-design conditions. A float valve or equivalent sensor means in the condenser sump detects that the liquid level is in excess of normal limits. The sensor causes a valve to open and to permit flow of the liquid through the bypass conduit. Under normal conditions, the liquid level in the subcooler portion of the condenser remains within the design limits, and the bypass conduit remains shut off. Thus under normal conditions, i.e., during steady state operation, all of the liquid refrigerant is cycled through the turbine expander to permit recovery of energy and reduction in compressor motor torque. However, when there is a change in operation conditions, the bypass conduit cuts in to provide a flow of liquid refrigerant from the condenser sump directly to the evaporator.

The above and many other objects, features, and advantages of this invention will become apparent from the ensuring description of a preferred embodiment, to be read in conjunction with the accompanying Drawing.

DETAILED DESCRIPTION OF THE PREFERRED EMBODIMENT

Figure 1:
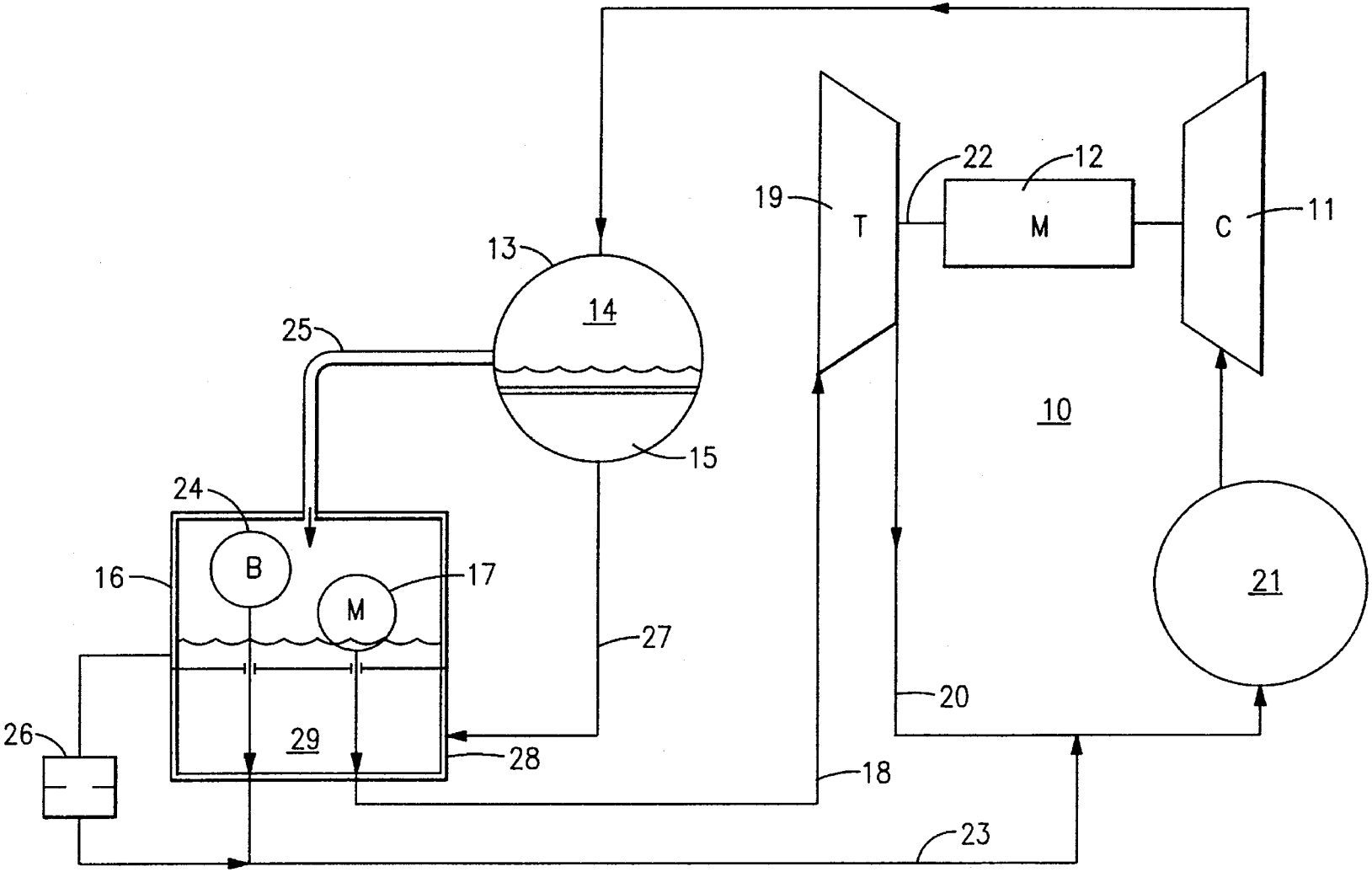
FIG. 1 is a schematic view of a single-fluid compression/expansion refrigeration system of the type that incorporates a turbo-expander, showing a bypass conduit according to a first embodiment of this invention.

With reference to the Drawing, and initially to FIG. 1, a refrigeration system 10 for a heat pump, refrigerator, chiller or air conditioner is shown schematically to comprise a compressor 11 that is driven by an electric motor 12 or other prime mover. The compressor 11 compresses a working fluid that exists in the system in its liquid and vapor phases or states. The compressor discharges the compressed vapor, at high pressure and high temperature, into a condenser/subcooler assembly 13 which exhausts heat from the working fluid and condenses the high pressure vapor into the high pressure liquid. The condenser has a main heat exchanger 14 for removing heat from the condensing vapor and a sensible subcooler 15 for removing heat from the condensed liquid.

The liquid refrigerant collects in a valve chamber 28, where a pilot chamber 16 contains a main float valve 17 that governs the rate of flow. The liquid refrigerant flows from the chamber 28 through a main turbine conduit 18 into a turbine expander 19. The high-pressure liquid flows into a high pressure port and drives a turbine rotor with the kinetic energy of the expanding working fluid. A portion of the energy imparted to the working fluid by the compressor 11 is recovered in the expander 19. From here, another conduit 20 carries the working fluid at low pressure into an evaporator 21 where the working fluid absorbs heat from an environmental zone, and the absorbed heat converts the working fluid from the liquid to the vapor state. The vapor from the evaporator 21 reenters the compressor 11 on an intake (low-pressure) side. In this schematic view, a linkage 22 from the turbine expander 19 to the compressor 11 mechanically joins the shafts of these two elements, so that the turbine expander 19 actually assists the motor 12 in driving the compressor 11. The turbine expander 19 relieves some of the compressor load on the motor 12, so that the refrigeration cycle is operated more efficiently than is possible with a different type of expander, such as a throttling expansion valve.

The liquid level at the entrance to the subcooler 15 is controlled by a float-valve-operated level control system 29. The majority of the liquid flow leaves the sensible subcooler 15 through a subcooler drain 27, and enters a valve chamber 28. The level of the liquid working fluid in the subcooler 15 is maintained by an overflow weir 25 that allows a minor portion of the condensed liquid to flow into the pilot chamber 16. In the pilot chamber, the main float valve 17 rises or falls with the liquid level, to allow the main flow to leave the valve chamber through the main turbine conduit or pipe 18. A drain line with a drain orifice 26 continuously bleeds the pilot chamber 16 to the low pressure side of the system. If the level entering the subcooler 15 is below the entrance of the weir 25, no liquid flow will enter the pilot chamber 16. The pilot chamber drain orifice 26 will bleed liquid out of the pilot chamber, the pilot chamber level will drop, and the main float valve 17 will close. This restricts the main flow leaving the subcooler through conduit 27, thereby forcing the level at the entrance of the subcooler 15 to rise. If the liquid level in the condenser assembly 13 rises significantly above the control weir 25, too much flow enters the pilot chamber 16. In this case, the the pilot chamber drain orifice 26 cannot bleed the liquid flow fast enough. The level in the pilot chamber 16 rises, so that the main float valve 17 will open, allowing more flow to pass through the subcooler drain conduit 27 and through the main turbine conduit 18 to the turbine expander 19. This causes the liquid level at the entrance of the subcooler 15 to drop. For steady state operation, the refrigerant flow over the weir 25 and the flow through the pilot chamber drain 26 will become equal, and the float valve 14 will remain at a stable position. This keeps the liquid level entering the subcooler 15 at a steady-state level.

The majority of the liquid refrigerant flows from the level control system 29 through the main conduit 18 into the turbine expander 19. The turbine expander 19, coupled to the compressor motor 12 through a shaft or a linkage 22, absorbs a portion of the kinetic energy of the working fluid and transfers it to the motor 12 to reduce some of the compressor load on the motor 12. Consequently, with the turbine expander the refrigeration cycle is operated more efficiently than is possible with a different type of expander, such as a throttling expansion valve. The low pressure exhaust flow of the turbine expander 19 flows through the conduit 20 to the evaporator or cooler 21 where the working fluid absorbs heat from the environmental zone, and the absorbed heat converts the working fluid from liquid to vapor state. The vapor re-enters the intake of the compressor 11, and the cycle is repeated.

With the efficient use of a turbine expander, higher cooling efficiency is possible. With high pressure refrigerants, such as R12, R22, and R134A, the throttling loss through a standard expansion valve can be as high as 20%, and for a low pressure refrigerant such as R123 or R245ca, the throttling loss can be 12%. However, if a throttling type expander can be replaced with a turbine expander having an efficiency of 50%, a significant amount of this throttling loss can be recovered. Thus, a turbine expander that is directly (i.e., mechanically) coupled to the shaft of the compressor can achieve a measurable improvement in refrigeration efficiency. Typically, the turbine expander has nozzles of fixed dimension and orifice size, which are based on the design steady-state operating conditions of the system. An example of a turbine expander is shown in commonly-assigned U.S. Pat. No. 4,467,613, filed Apr. 5, 1994. The disclosure of that application is incorporated herein by reference.

Figure 3:
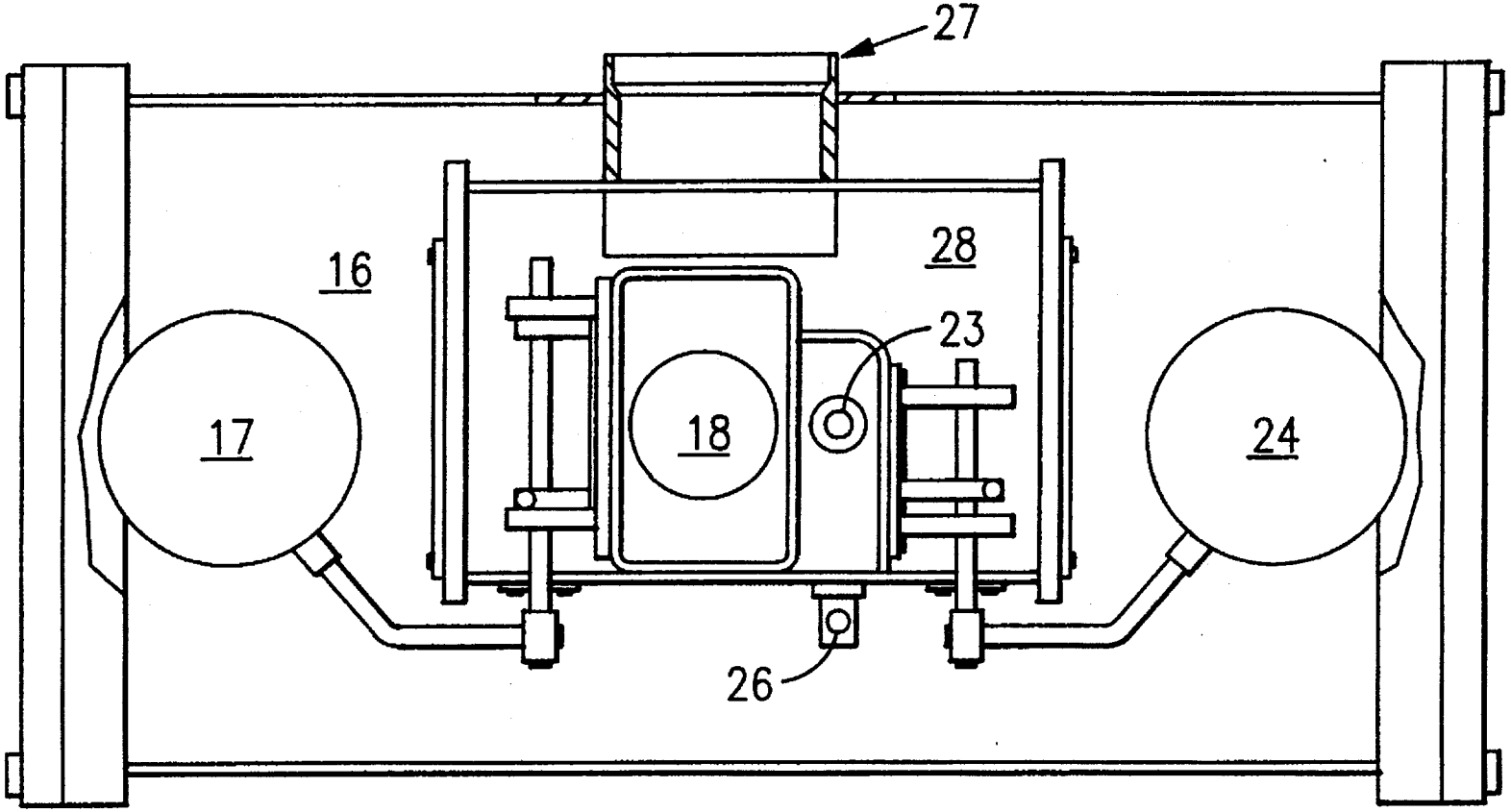
FIGS. 3, 4, and 5 are a top cutaway view, a front elevational cutaway view, and a side elevational cutaway view, respectively, of a float chamber for the sump of the condenser stage of the embodiment of FIG. 1.
Figure 4:
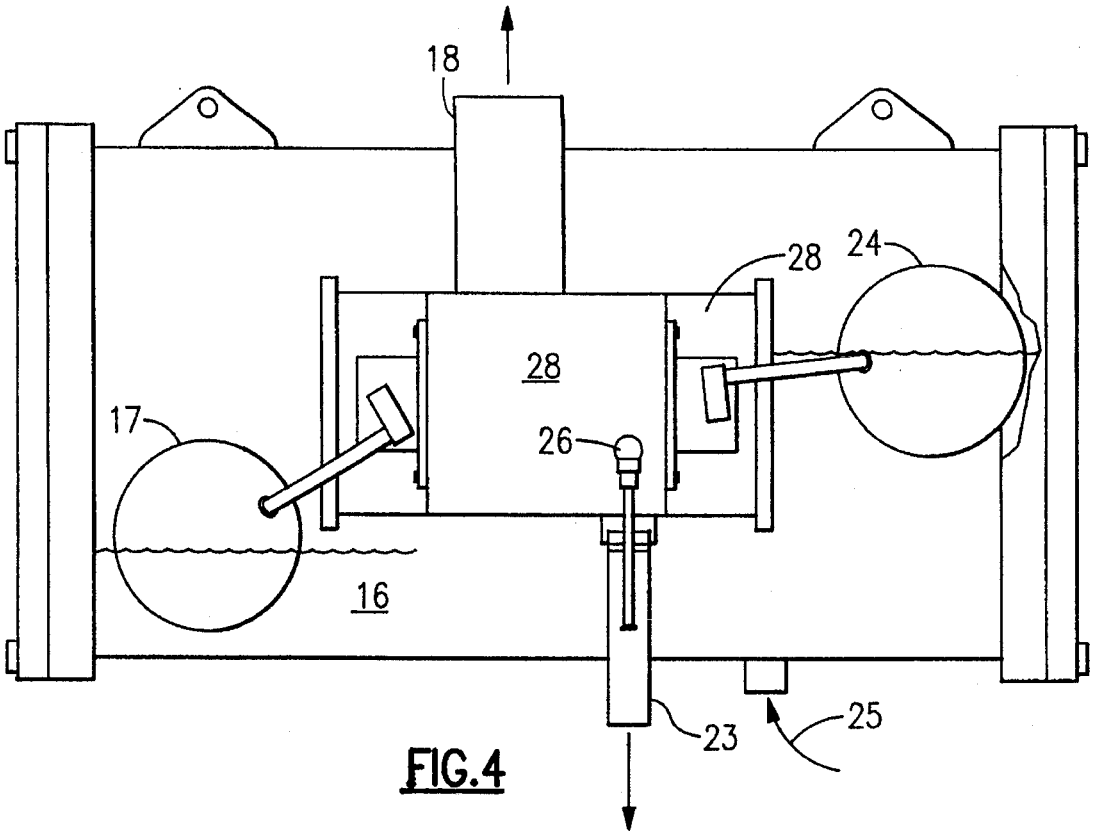
Figure 5:
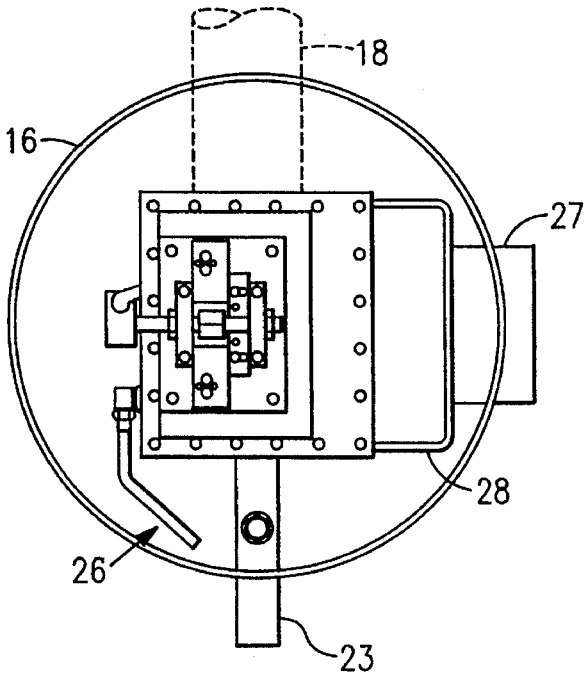

Details of a level control system and float valve mechanism of this embodiment are shown in FIGS. 3, 4, and 5. Here liquid refrigerant flows from the condenser 14 through the weir 25 into the pilot chamber 16, and the liquid rises to a level that depends on the heating/cooling load, and also on other factors. The first or main float valve 17 is shown on the left in this view, with the bypass float valve 24 being shown on the fight. The valve chamber 28 is disposed in the central part of the level control system 29, with the main conduit or pipe 18 exiting to the turbine and a bypass pipe 23 exiting the valve chamber to connect with the conduit 20. In this embodiment the bypass valve mechanism 24 is proportional. That is, the amount of liquid that is valved through the bypass conduit 23 is generally proportional to the level of the liquid in the valve chamber, above an initial high level.

The turbine expander, being a fixed-geometry device, and sized for a particular steady-state condition, may have too small a capacity to handle the refrigerant flow under some transient or off-design conditions. Even though the main float valve 17 would be in its completely open position, the level at the entrance of the subcooler 15 would stack up in the main condenser 14. This condition would result in system safety shut down, because of low evaporator pressure, to prevent the evaporator water/brine from freezing. To prevent the system from shutting down, the second or bypass float valve 24 comes into play. The bypass float valve 24 has its activation height set so that it remains closed until the main float valve 17 is completely open. During system start up, during transient conditions or steady-state low-head or high-weight flow conditions, the bypass float valve 24 will open as needed to allow only the necessary quantity of bypass flow through the bypass conduit 23, to the low pressure side of the system 20 or 21. During off-design conditions, the bypass conduit 23 communicates between the drain line 27 of the condenser assembly 13 and the low-pressure conduit 20 and the evaporator 21. The conduit 23 feeds some of the liquid refrigerant around the turbine 19. Under normal conditions, the valve 24 is shut off and the liquid refrigerant passes through the main conduit 18 and the turbine expander 19.

Figure 2:
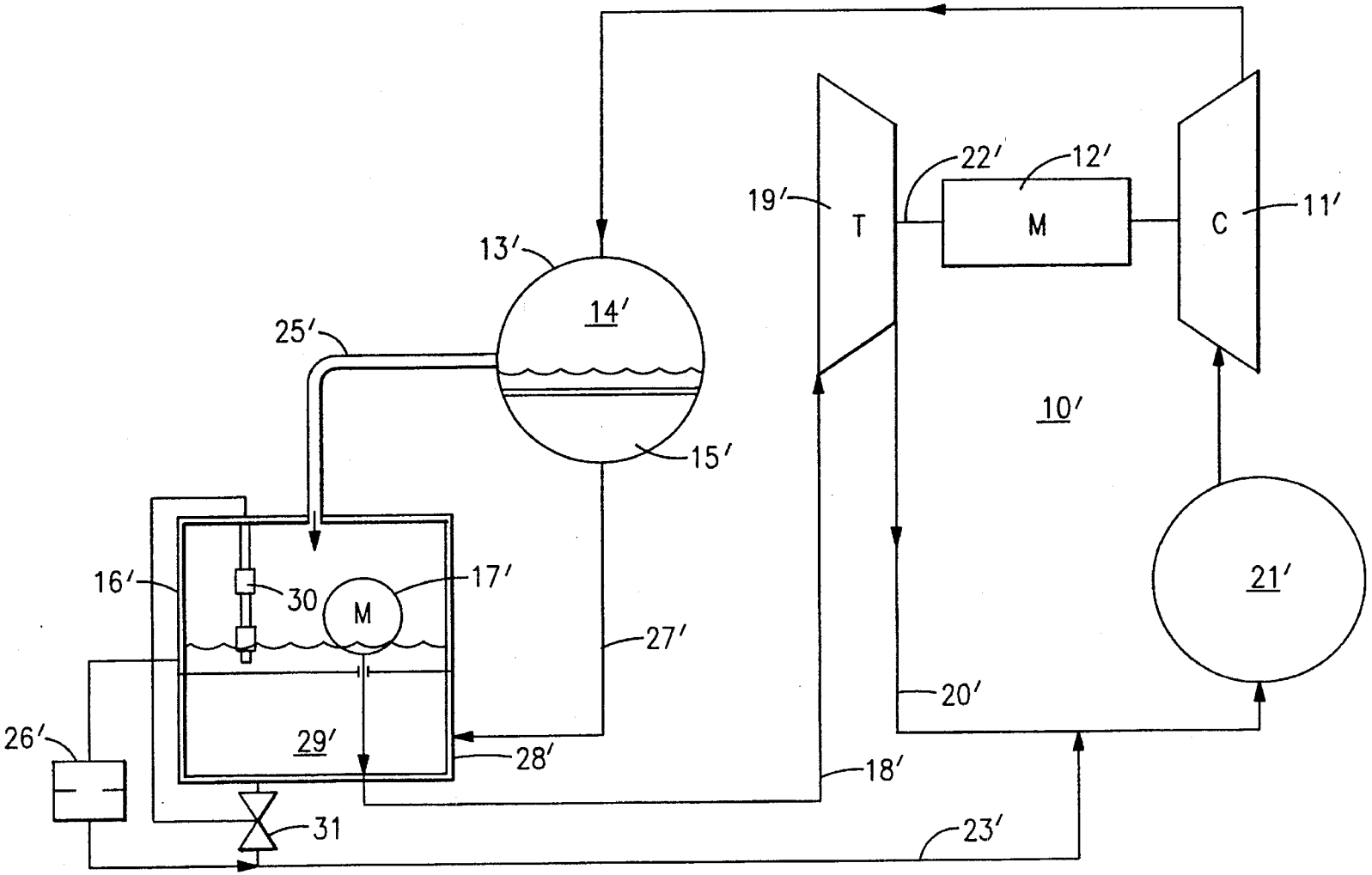
FIG. 2 is a schematic view of a single-fluid compression/expansion refrigeration system of the type that incorporates a turbo-expander, showing a bypass conduit according to a second embodiment of this invention.

A second embodiment of this invention is shown in FIG. 2. In this embodiment, elements that are in common with the embodiment of FIG. 1 are identified with the same reference numbers, but primed. A description of the main features need not be repeated here. In this embodiment, rather than the float valve 24, a float switch 30 is actuated when the liquid level in the pilot chamber 16' reaches a predetermined high level. The float switch actuates a bypass solenoid 31 that is connected in line in the bypass conduit 23'. This opens the bypass conduit 23' to liquid flow when the off-design conditions do not permit sufficient mass flow through the main conduit 18' and the turbine 19'.

Many other possible embodiments could be employed to bypass liquid refrigerant around the turbine 19 or 19' during off-design conditions.

While this invention has been described in detail with reference to certain preferred embodiments, it should be understood that the invention is not limited to those embodiments. Rather, many modifications and variations will present themselves to persons skilled in the art without departing from the scope and spirit of this invention as defined in the appended claims.

What is claimed is:

1. Single fluid compression/expansion refrigeration apparatus which comprises a fill of a fluid refrigerant that exists in the apparatus as liquid and as vapor; a compressor for compressing the vapor thereby adding compression energy to the refrigerant fluid; having an input shaft, an inlet to receive the fluid at a reduced pressure and an outlet from which the fluid is delivered at an elevated pressure; a drive motor having a drive shaft coupled to said input shaft to rotate the same; condenser means that exhausts heat from the condensed refrigerant to convert the compressed vapor to liquid, said condenser means including a sump for accumulating said liquid; a turbine expander having an inlet supplied by said sump of said condenser means with said fluid at said elevated pressure as a combination of liquid and vapor for expanding the refrigerant fluid to said reduced pressure, including an output shaft coupled to said rotary compressor input shaft, for recovering at least a part of the compression energy of the refrigerant fluid as it is being expanded and an outlet providing said refrigerant fluid at said reduced pressure, and evaporator means situated in circuit between the outlet of said turbine expander and the inlet of said compressor and fed with said refrigerant fluid at said reduced pressure for evaporating the refrigerant liquid to vapor and absorbing heat, and returning the resulting vapor to said compressor inlet; and a bypass conduit connected between said condenser means and said evaporator means, including valve means for selectively permitting said fluid to flow in said bypass conduit from said condenser means to said evaporator means, and sensor means for detecting an accumulation of said liquid in said condenser means to actuate said valve means.

2. Single fluid compression/expansion refrigeration apparatus according to claim 1, wherein said valve means includes a bypass float valve situated within said sump.

3. Single fluid compression/expansion refrigeration apparatus according to claim 1, wherein said valve means includes a float switch situated in said sump and a solenoid valve disposed in line in said bypass conduit and electrically coupled to said float switch.

4. Single fluid compression/expansion refrigeration apparatus which comprises a fill of a fluid refrigerant that exists in the apparatus as liquid and as vapor; a compressor for compressing the vapor thereby adding compression energy to the refrigerant fluid; having an input shaft, an inlet to receive the fluid at a reduced pressure and an outlet from which the fluid is delivered at an elevated pressure; a drive motor having a drive shaft coupled to said input shaft to rotate the same; condenser means that exhausts heat from the condensed refrigerant to convert the compressed vapor to liquid, said condenser means including a sump for accumulating said liquid; a main float valve in said sump for maintaining a predetermined liquid level in said sump and regulating flow of said refrigerant fluid through a conduit; a turbine expander having an inlet supplied by said conduit with said fluid at said elevated pressure as a combination of liquid and vapor for expanding the refrigerant fluid to said reduced pressure, including an output shaft coupled to said rotary compressor input shaft, for recovering at least a part of the compression energy of the refrigerant fluid as it is being expanded and an outlet providing said refrigerant fluid at said reduced pressure, and evaporator means situated in circuit between the outlet of said turbine expander and the inlet of said compressor and fed with said refrigerant fluid at said reduced pressure for evaporating the refrigerant liquid to vapor and absorbing heat, and returning the resulting vapor to said compressor inlet; a bypass conduit connected between said condenser means and said evaporator means; bypass valve means for selectively permitting said fluid to flow in said bypass conduit from said condenser means to said evaporator means; and sensor means for detecting an accumulation of said liquid in said condenser means to actuate said valve means.

5. Single fluid compression/expansion refrigeration apparatus according to claim 4, wherein said bypass valve means includes a bypass float valve, and said sensor means includes a float situated within said sump.

6. Single fluid compression/expansion refrigeration apparatus according to claim 4, wherein said bypass valve means includes a solenoid valve disposed in line in said bypass conduit, and said sensor means includes a float switch situated in said sump and electrically coupled to said solenoid valve.

* * * * *